US006017027A

United States Patent [19]

Jaeger

[11] Patent Number: 6,017,027

[45] **Date of Patent: *Jan. 25, 2000**

[54] METHOD AND APPARATUS FOR OPENING FLEXIBLE, SHEET PRODUCTS

[75] Inventor: Erich Jaeger, Frauenfeld, Switzerland

[73] Assignee: Ferag AG, Hinwil, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/920,041

[22] Filed: Aug. 28, 1997

[30] Foreign Application Priority Data

Sep. 6, 1996 [CH] Switzerland ..... 2198/96

[51] Int. Cl.[7] ..... B65H 5/30

[52] U.S. Cl. ..... 270/52.23; 270/52.19

[58] Field of Search ..... 270/52.19, 52.23, 270/52.24, 52.25, 52.27, 52.28

[56] References Cited

U.S. PATENT DOCUMENTS

| | | | |
|---|---|---|---|
| 3,561,751 | 2/1971 | Dutro | 270/52.24 |
| 3,692,301 | 9/1972 | Wetter | 270/52.23 |
| 3,722,877 | 3/1973 | Wetter | 270/52.23 |
| 4,275,873 | 6/1981 | Rathert | 270/52.23 |
| 4,398,710 | 8/1983 | Hänsch | 270/55 |
| 4,401,300 | 8/1983 | Morin | 270/52.23 |
| 4,420,146 | 12/1983 | Reist | 270/55.23 |
| 4,463,941 | 8/1984 | Schlough | 270/54 |
| 4,684,117 | 8/1987 | Honegger et al. | 270/54 |
| 4,968,017 | 11/1990 | Depetris | 271/12 |
| 5,106,070 | 4/1992 | Reist | 271/12 |
| 5,112,041 | 5/1992 | Honegger | 271/286 |
| 5,292,111 | 3/1994 | Hansch | 270/54 |
| 5,354,043 | 10/1994 | Reist | 270/54 |
| 5,399,222 | 3/1995 | Reist | 156/277 |
| 5,441,245 | 8/1995 | Fluckiger | 270/52.23 |
| 5,443,250 | 8/1995 | Gosslinghoff | 270/52.23 |
| 5,462,266 | 10/1995 | Meier | 270/54 |
| 5,474,285 | 12/1995 | Stauber | 270/54 |
| 5,492,316 | 2/1996 | Moffa et al. | 270/52.24 |

FOREIGN PATENT DOCUMENTS

| | | |
|---|---|---|
| 0576728A1 | 1/1994 | European Pat. Off. . |
| 1024530 | 8/1958 | Switzerland . |
| 641113A5 | 6/1979 | Switzerland . |
| 684085A5 | 4/1991 | Switzerland . |
| 4434178A1 | 9/1994 | Switzerland . |

*Primary Examiner*—William E. Terrell
*Assistant Examiner*—Patrick Mackey
*Attorney, Agent, or Firm*—Alston & Bird LLP

[57] ABSTRACT

Flexible, sheet products which are to be opened have a first product part and a second product part. The product parts are connected to one another at a connecting edge, and the first product part has a border region which projects beyond the second product part. The products are conveyed with a leading edge running obliquely with respect to the conveying direction. An end section of the leading edge abuts a fixed stop wherein the first product part is arched in a lateral corner region. This results in the second product part lifting off from the first product part so as to define an opening. As the products are further conveyed, a holding-open element is inserted into the opening to maintain the first product part separate from the second product part. After the arching operation, the first product part springs over the stop and is further conveyed with the second product part.

15 Claims, 5 Drawing Sheets

METHOD AND APPARATUS FOR OPENING FLEXIBLE, SHEET PRODUCTS

FIELD OF THE INVENTION

The present invention relates to a method and an apparatus of opening flexible, sheet products.

BACKGROUND OF THE INVENTION

EP-A-0 576 728 discloses a method and an apparatus for opening centrally folded sheets which are conveyed in a stepwise manner in an imbricated formation, in which each sheet rests on the preceding sheet, by means of a clamp-type conveyor with pivotable clamps. The clamps retain the sheets at their folded edge, which trails with respect to the open edge located opposite it. An opening device with a suction head which can be raised and lowered is arranged to the side of the clamp-type conveyor. By virtue of the clamps being pivoted, the sheets are moved out of an imbricated formation, wherein the edge runs at right angles to the conveying direction, into an imbricated formation wherein the edge runs obliquely with respect to the conveying direction and in which, on the side facing the opening device, the sheets project beyond the adjacent sheets by way of a lateral corner region. As soon as the corner region of one sheet in each case has arrived at the suction head, the clamp-type conveyor is brought to a standstill, whereupon the suction head grips the top sheet part in the corner region and lifts it off from the bottom sheet part.

When the clamp-type conveyor is set in operation again, the suction head releases the lifted-off sheet part, which comes into abutment against a profile holding-open element. The clamps are then pivoted in the opposite direction, with the result that the open corner region, which is held open by means of the holding-open element, then becomes the leading corner. An acceleration conveyor grips the bottom product part in the leading corner region in order to deposit the open sheet on a saddle of a gatherer-stitcher. As a result of the stepwise transportation, operation is not smooth and the processing capacity may well be restricted. Furthermore, the design of the apparatus is complicated.

A method of, and an apparatus for, opening multi-sheet, centrally folded products by way of continuous conveying is disclosed in EP-A-0 344 787. A cam-type conveyor transports the products in an imbricated formation, in which each product rests on the preceding product, with the open edge leading with respect to the folded edge and running obliquely with respect to the conveying direction. An opening device with a plurality of suction-head pairs arranged one behind the other at the same spacing as the products is provided to the side of the cam-type conveyor. The suction-head pairs can be moved synchronously in and counter to the conveying direction in time with the printed products, and the suction heads of the suction head pairs can be moved towards one another, and away from one another, transversely with respect to the conveying plane. They grip in each case, the lowermost and the uppermost of the mutually abutting sheets in the lateral corner region and lift them off from the rest of the sheets. After the lifted-off sheets have been released, they come into abutment against directing elements, in order to be directed away above and beneath the following suction heads. The products are opened gradually in this manner in order then to be deposited on the saddle of a gatherer-stitcher. The gradual opening of the products need a considerable amount of time and requires a high-outlay opening device. The complicated movement of the suction heads, in turn, restricts the processing capacity.

SUMMARY OF THE INVENTION

It is an object of the present invention to provide a method and an apparatus for opening flexible, sheet products which eliminate the disadvantages of the known methods and apparatuses.

The product parts which are to be opened include first and second product parts which are connected to one another at a connecting edge. A border region of the second product part extends beyond the edge of the first product part, along a leading edge of the product located opposite the connecting edge. The present invention is directed to continuously conveying the products one behind the other in a conveying direction wherein the leading edge of each product extends oblique relative to the conveying direction. An outer flat side of the first product part is contacted during the conveying step with a guide surface. A trailing end section of the leading edge of the product is contacted with a fixed stop which projects from the guide surface.

Accordingly, the first product part is arched in the lateral corner region and the second product part is lifted off of the first product part so as to form an opening. The lifted off second product part is supported on the side thereof facing the first product part by a fixed holding-open element which penetrates into the opening. The product is further continuously conveyed in the conveying direction wherein the first product part automatically springs over the stop and is further conveyed resting on the holding-open element.

The invention utilizes the inherent elasticity of the flexible products for opening purposes. The oblique positioning of the products exposes a corner region and a section of the edge, and the fixed stop and fixed holding-open element can interact with the corner region and edge section without adversely affecting the adjacent products. The border section of the first product part allows the product to be opened in a single step at the desired location and permits the stop to be designed such that it can hold back the first product part reliably for opening purposes. The guide surface interacting with the outer flat side of the first product part ensures that the stop only acts on the first product part and the product is thus opened precisely between the first and second product parts. As a result of the oblique positioning of the product and of the stop acting on the products in the trailing end section of the leading edge, the products are only acted on in the corner region, which results, on the one hand, in only small forces acting on the products and, on the other hand, in reliable opening in a short period of time and over a short conveying path.

BRIEF DESCRIPTION OF THE DRAWINGS

The present invention will be described in more detail with reference to exemplary embodiments illustrated in the drawing, in which, purely schematically.

DETAILED DESCRIPTION OF THE PREFERRED EMBODIMENTS

Figure 1:
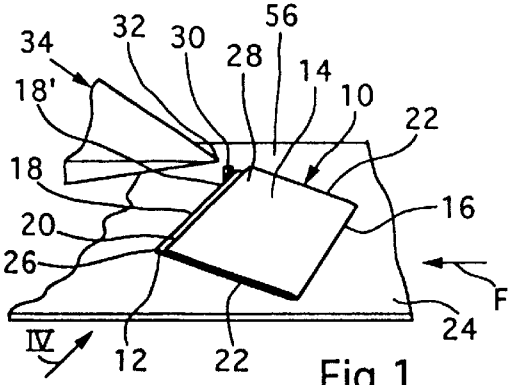
FIGS. 1 to 3 are a perspective illustration, at three successive points in time, of the operation of opening a product whose first product part rests on a conveying plane.

The sheet-like product 10 to be processed has a first product part 12 and a second product part 14. The two product parts 12 and 14 are connected to one another along a connecting edge 16, and the first product part 12 projects beyond the second product part 14 by way of a strip-like border region 20 which extends along the leading edge 18 located opposite the connecting edge 16. The product parts 12, 14 are not connected to one another along the two side edges 22 which connect the leading edge 18 to the connecting edge 16. The product 10 is thus open along the side edges and on the border located opposite the connecting edge 16.

The product 10 shown is a multi-sheet printed product, for example a periodical, a newspaper or a part thereof, which is folded in an off-center manner and of which the folded edge forms the connecting edge 16. The products 10 may also be folded sheets or bound, stitched or stapled printed products.

The product 10 rests on a horizontal conveying plane 24 by way of the outer flat side of the first product part 12. As seen in the conveying direction F, the edge 18 leads with respect to the connecting edge 16, and the connecting edge 16 and leading edge 18 run obliquely with respect to the conveying direction F. The product 10 thus has a leading corner 26 at one end of the leading edge 18 and a lateral corner region 28 in the area neighboring the trailing end section or region 18' of the leading edge 18, the end region 18' being remote from the corner 26.

Projecting above the conveying plane 24 is a pin stop 30 for interacting with the end section 18' of the edge 18 of the first product part 12. Located adjacent to the stop 30, and above the same, is the tip 32 of a holding-open element 34 which, as seen in the conveying direction F, widens in the form of a wedge. The oblique positioning of the products 10 is selected such that the connecting edge 16 can move past the stop 30 at a distance therefrom.

The operation of opening the product 10 will now be described with reference to FIGS. 1 to 6. The product 10 is conveyed continuously in the conveying direction F, as a result of which it comes into abutment against the stop 30 by way of a stop region of the end section 18', as is indicated in FIGS. 1 and 4. Since the product 10 continues to be conveyed continuously and the end section 18' is obstructed from moving along in the conveying direction F by the fixed stop 30. Thus, the first product part 12 is arched in the lateral corner region 28, as can be seen, in particular, from FIG. 5 wherein the arching is designated by 36. This arching and the inherent stability of the second product part 14 result in the second product part 14 lifting off in the corner region 28, an opening 38 being formed in the process. As the product 10 continues to be transported, the fixed holding-open element 34 is then inserted into the opening 38 by way of the tip 32, with the result that the inner side of the lateral corner region 28 of the lifted-off, second product part 14 rests on the holding-open element 34, as can be seen, in particular, from FIG. 2. As the product further conveyed, the restrained, arched first product part 12 springs over the stop 30, as a result of its flexible properties, and, as a result of its elasticity, comes to rest flatly on the conveying plane 24 again, the product 10 being held open, and if appropriate being opened further, by means of the holding-open element 34 as transportation continues, as can be seen from FIGS. 3 and 6.

Since the stop 30 acts on the end section 18' and, as a result, the product 10 is only opened in the lateral corner region 28, only small forces act on the product, with the result that the latter is neither damaged nor changed in terms of position. As a result of the interaction between the stop 30 and the border region 20, the product 10 is opened between the first product part 12 and the second product part 14. Since the first product part 12 is arched and the second product part 14 is thus raised considerably with respect to the conveying plane 24, the stop 30 can project above the conveying plane 24 by an amount which is considerably greater than the thickness of the first product part 12. As can be seen from the figures, the stop 30 can project by an amount which is greater than the thickness of the product 10, which helps ensure that the opening operation is carried out correctly.

Figure 7:
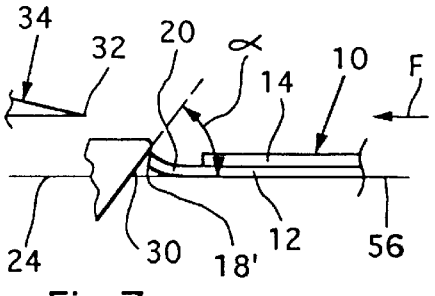
FIGS. 7 to 9 illustrate, in a manner similar to FIGS. 4 to 6, the operation of opening the printed product, at three different points in time, by means of a fixed stop which runs at an acute angle with respect to the conveying plane.
Figure 8:
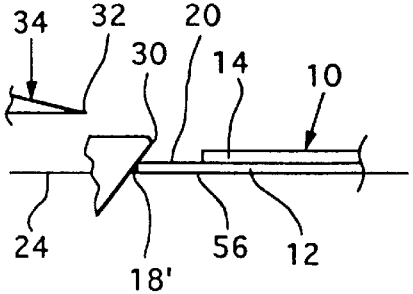
Figure 9:
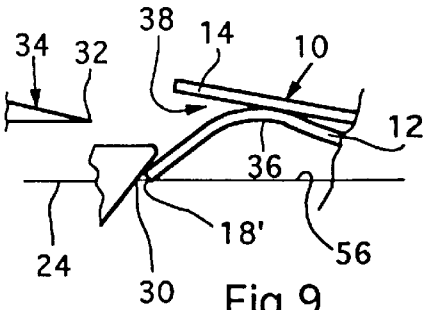

The reliability of the opening operation can be increased further by the stop 30 being designed such that, as seen in the conveying direction F, it encloses an angle a with the conveying plane 24, as is shown in FIGS. 7 to 9. The stop 30, which projects above the first product part 12, thus forms a directing surface for the end section 18', with the result that the first product part 12 then comes into flat abutment against the conveying plane 24 by way of its border region 20 even if it is bent away therefrom, as is indicated in FIGS. 7 and 8. Furthermore, the wedge action of the stop 30 assists the arching of the first product part 12, as is shown in FIG. 9. The designations in FIGS. 7 to 9 correspond to those used in FIGS. 1 to 6, and they are only indicated if they are necessary for understanding the figures.

Figure 10:
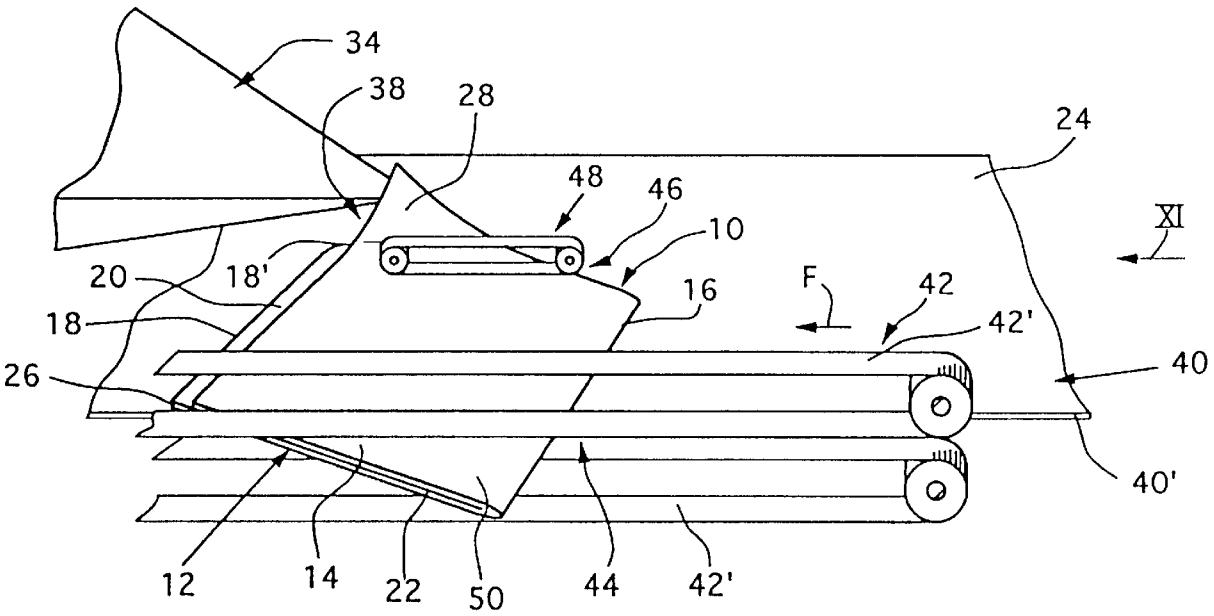
FIG. 10 illustrates, in perspective, an apparatus for opening the products.
Figure 11:
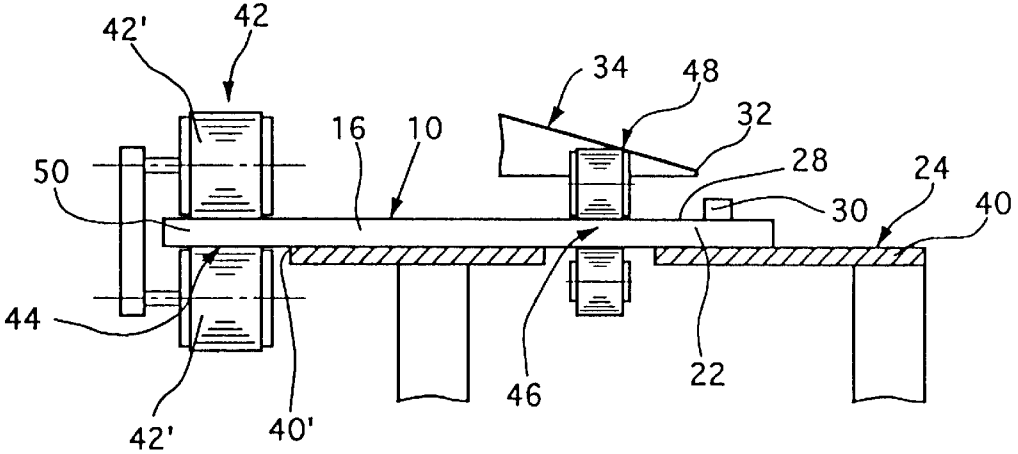
FIG. 11 illustrates a side view, partially in section, of the apparatus shown in FIG. 10 wherein the side view is taken in the direction of the arrow XI in FIG. 10.

In the case of the embodiment of the apparatus which is shown in FIGS. 10 and 11, the conveying plane 24 is formed by a horizontal panel 40. Running along the left-hand border 40' as seen in the conveying direction F, of the panel 40 is the belt conveyor 42 with two conveying belts 42' which together form a conveying gap 44 for the product 10. The top, active strand of the bottom conveying belt 42' is in alignment with the conveying plane 24. The conveying belts 42' are driven at constant speeds in opposite directions in order to move the respective product 10 in the conveying direction F.

The stop 30 is fastened on the panel 40 at a distance from the belt conveyor 42, as seen at right angles to the conveying direction F, and projects above the panel 40. Furthermore, 34 designates the holding-open element, of which the tip 32, in turn, is located at least approximately above the stop 30 and at a distance therefrom.

Furthermore, the apparatus has a guide-belt pair 48 forming a guidance gap 46. The guidance gap 46 begins upstream of the stop 30 and terminates approximately alongside the latter, as seen in the conveying direction F. The belts of the guide-belt pair 48 are guided, in the known manner, around deflection rollers at the beginning and end of the guidance gap 46. In the region of the guide-belt pair 48, the panel 40 has a through-passage in which the bottom guide belt of the guide-belt pair 48 is arranged, with the result that the top, guiding strand of said guide-belt pair runs in the conveying plane 24. The guide-belt pair 48, which extends in the conveying direction F, is mounted so as to circulate freely.

The printed product 10 rests on the panel 40 by way of the outer flat side of the first product part 12, and, in turn, the edge 18 and the connecting edge 16 parallel thereto run obliquely with respect to the conveying direction F. In the direction at right angles to the conveying direction F, the product 10 is arranged such that its area adjacent to the lateral corner region 28 comes to rest in the guidance gap 46. By way of the corner region 50, which is located diagonally opposite the lateral corner region 28 and is bounded by a side edge 22 and the connecting edge 16, the product 10 projects beyond the border 40' of the panel 40 and thereby engages through the conveying gap 44.

As soon as the product 10 which is to be opened passes into the active region of the belt conveyor 42 by way of its further corner region 50, it is conveyed continuously in the conveying direction F and runs into the guidance gap 46 with its edge 18 leading. The opening operation then proceeds in exactly the same manner as has been described in conjunction with FIGS. 1 to 9. The guide-belt pair 48, which forms a guiding and holding-down element, guides the product 10, on the one hand, and, on the other hand, presses down the second product part 14 in the area adjacent to the lateral corner region 28, this resulting in arching 36 with steeply rising flanks, and thus in a large opening 38.

Figure 2:
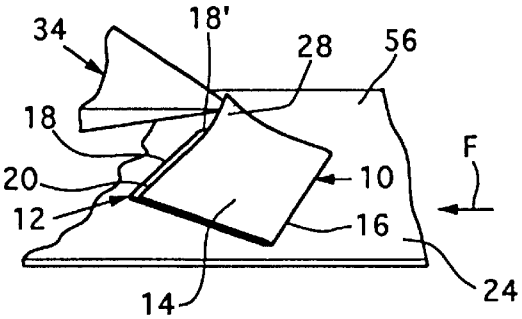
Figure 3:
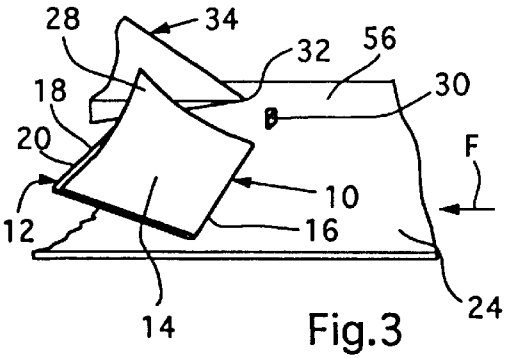
Figure 4:
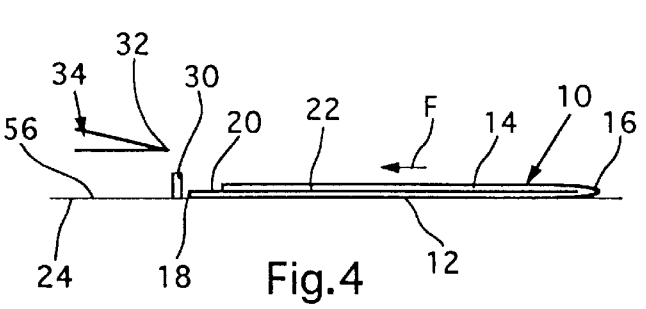
FIGS. 4 to 6 illustrate, in a view in the direction of the arrow IV in FIG. 1, the operation of opening the printed product shown in FIGS. 1 to 3 wherein products are shown at the same points in time as in FIGS. 1 to 3.
Figure 5:
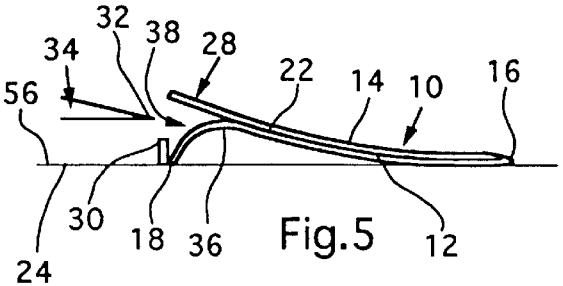
Figure 6:
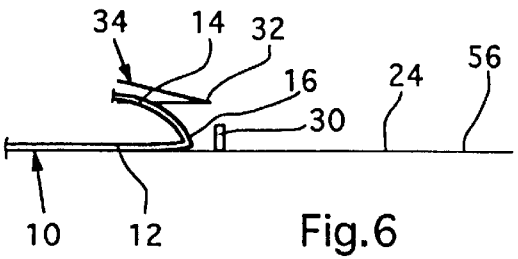
Figure 13:
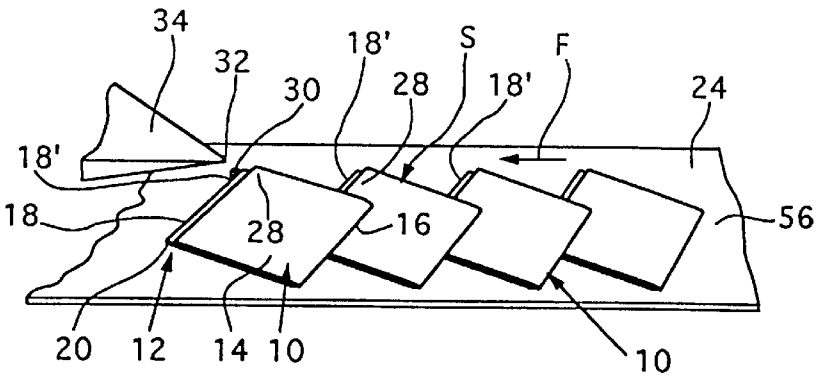
FIG. 13 illustrates, in the same illustration as in FIG. 12, products which are arranged one behind the other in imbricated formation and are to be opened.
Figure 12:
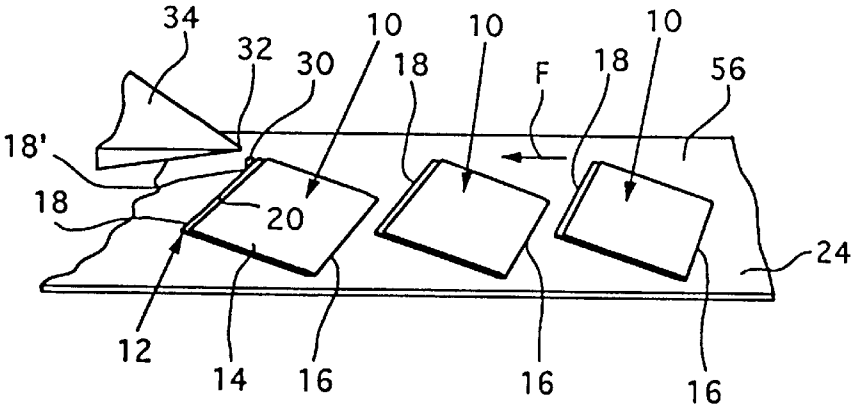
FIG. 12 illustrates, in the same illustration as FIG. 1, the arrangement of products which are spaced apart one behind the other and are to be opened.

FIGS. 12 and 13 show the apparatus according to FIGS. 10 and 11 in the same way, in a vastly simplified manner, as in FIGS. 1 to 3. In the latter figures, the opening operation is illustrated and described with reference to a single product 10. The products 10 can be conveyed, for opening purposes, in a formation in which they are arranged separately one behind the other, as is shown in FIG. 12. In this case, the products 10, again, rest on the conveying plane 24 by way of the first product part 12. However, it is also possible for the products 10 to be conveyed in an imbricated formation S, as is indicated in FIG. 13. In this case, once again, the first product part 12 is located beneath the second product part 14 and each product rests on the following product. As a result of the oblique positioning of the products 10 with respect to the conveying direction F, the lateral corner region 28 and the end section 18' of the leading edge 18 are not overlapped by any of the other products 10. The products 10 thus do not obstruct either the access of the stop 30 to the end section 18' or the arching of the first product part 12 and formation of the opening 38. Rather, the overlapping of the products 10 assists the formation of the arching 36 with steep flanks, even if there is no guiding and holding-down element present.

Figure 14:
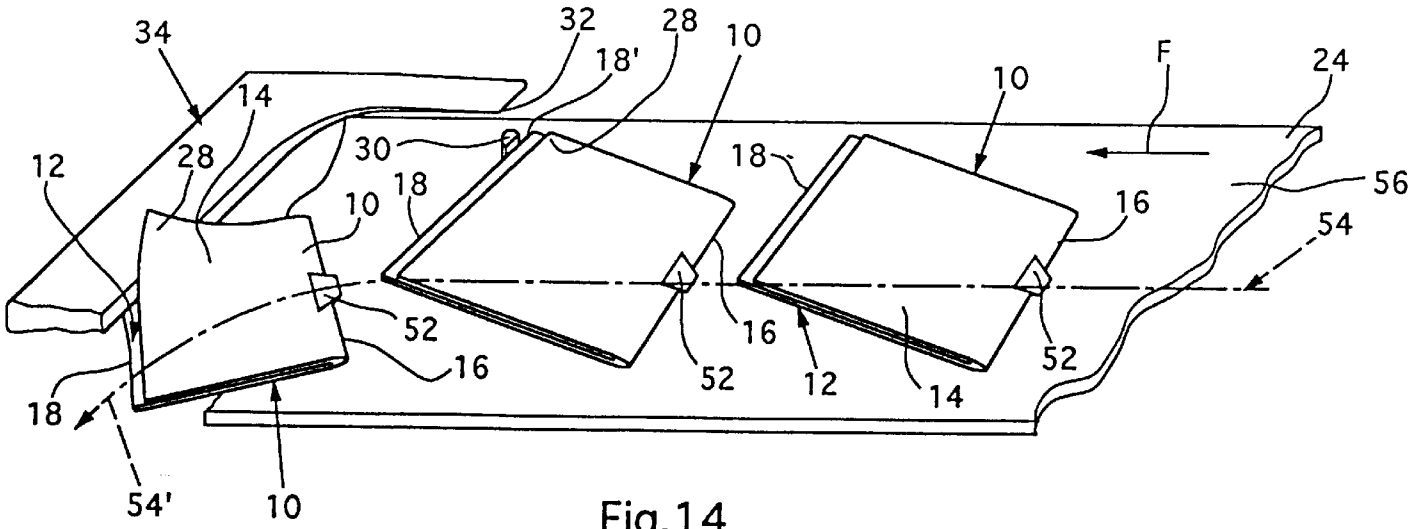
FIG. 14 illustrates a perspective illustration of a further embodiment of the apparatus for opening the products.
Figure 15:
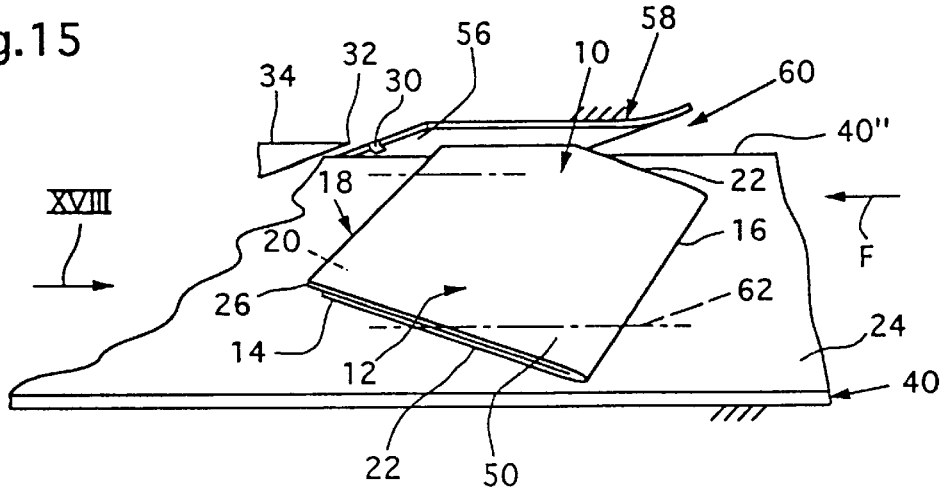
FIGS. 15 to 17 illustrate a perspective illustration, at three different points in time, of an apparatus for opening products which rest on a conveying plane by way of the flat side of the second product part.

In the case of the embodiment of the apparatus according to the invention which is shown in FIG. 14, the products 10 are transported in a state in which they are retained at their connecting edge 16 by means of clamps 52. The clamps 52 are spaced apart one behind the other on a drawing element 54, which is driven in circulation in the conveying direction F and is indicated by chain-dotted lines. The products 10 retained by the clamps 52 are, in turn, transported with their first product part 12 resting on the conveying plane 24. The leading edge 18 and parallel connecting edge 16, again, run obliquely with respect to the conveying direction F. The stop 30, offset laterally with respect to the drawing element 54, projects above the conveying plane 24. Once again, the tip 32 of the holding-open element 34 is located above the stop 30. Downstream of the stop 30, the drawing element 54 is guided around a curve 54'. The opening element 34 is designed to be adapted to the path of this curve, in order for the product 10, which is opened in the lateral corner region 28 by the action of the stop 30, to be held open and to be opened further by reducing the distance between the drawing element 54 and the holding-open element 34 or by changing the position of these elements relative to one another. This embodiment makes it possible, in a simple manner, for the products 10 to be supplied to, and deposited on, a saddle-like rest of a collecting means or another further-processing station.

The embodiments of the apparatus according to the invention which have been shown up until now are those in which the conveying plane 24 forms a guide surface 56 for the outer flat side of the first product part 12. The text which follows will now describe an embodiment of the apparatus according to the invention in which the guide surface 56 is separate from the conveying plane 24. As can be seen from FIGS. 15 to 21, the apparatus, again, has a conveying plane 24 which is formed by a panel 40. Arranged adjacent to the right-hand border 40", as seen in the conveying direction F, the border 4" extends in the conveying direction F. A plate-like guiding element 58 bounds a gap 70 together with the panel 40 and encloses an acute angle together with the imaginary extension of the conveying plane 24 as seen in a vertical plane running at right angles to the conveying direction (see, in particular FIGS. 18 and 19). As seen in plan view, the guiding element 58 overlaps the panel 40 and, at the same time, projects beyond the latter in the lateral direction. As seen in the conveying direction F, the beginning of the guiding element 58 is bent away from the panel 40, in order to form a tapering inlet 60 along with the panel 40. Adjoining the inlet 60, the guiding element 58 runs parallel to the edge formed by the border 40" and the conveying plane 24. With its surface facing the panel 40, the guiding element 58 forms a guide surface 56 for the first product part 12 of the product 10, as will be described at a later stage in the text.

Fastened at the downstream end of the guiding element 58 is a stop 30, which projects beyond the guide surface 56 and, as seen in the conveying direction, is located laterally outside the border 40". Located beneath the stop 30, and at a distance therefrom, is the tip 32 of the holding-open element 34, as can be seen particularly clearly from FIG. 20. The stop 30 is designed in the manner of a tongue and, once again, encloses an acute angle with the guide surface 56.

Figure 16:
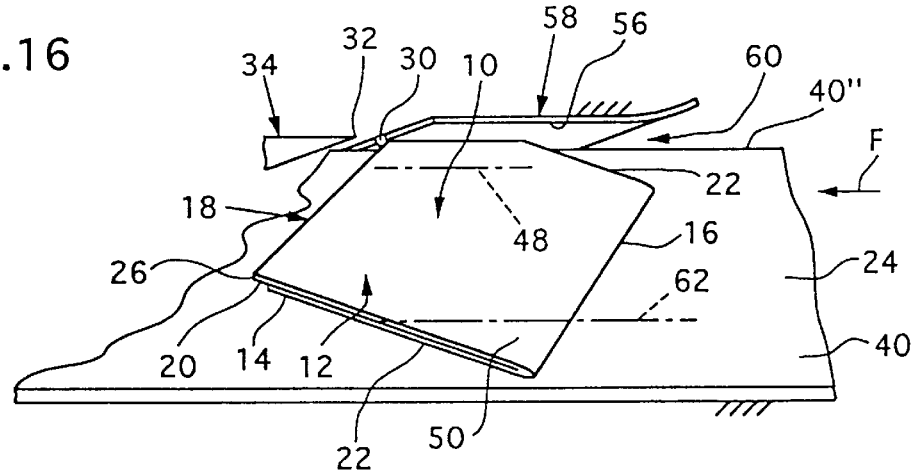
Figure 17:
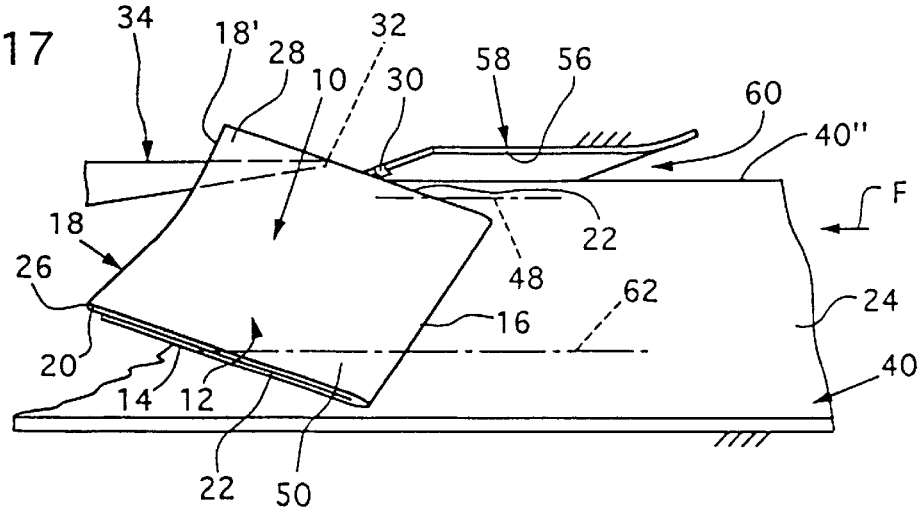
Figure 18:
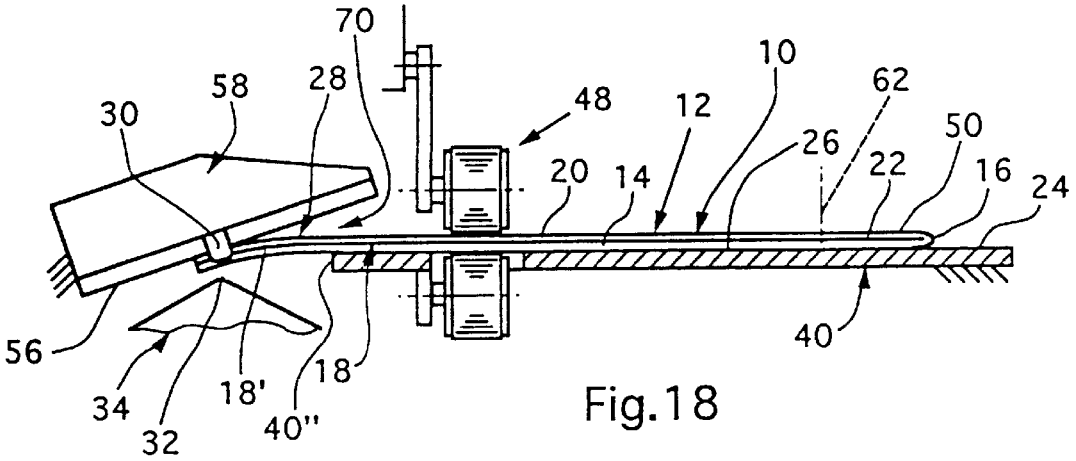
FIG. 18 illustrates, partially in section and in the direction of the arrow XVIII, the apparatus shown in FIG. 15.

In FIGS. 15 to 18, a chain-dotted line 62 indicates a conveying means which may be designed as a belt conveyor, as shown in FIGS. 10 and 11, or as a clamp-type conveyor, as shown in FIG. 14. A further, likewise chain-dotted line 48 indicates, in FIGS. 15, 16, 17 and 19, a guide-belt pair which, as can be seen, in particular, from FIG. 18, is designed in the manner shown in FIGS. 10 and 11 and described in conjunction with these figures. The guide-belt pair 48 is located at a distance from the border 40", said distance being considerably smaller than the distance from this border 40" to the conveying means 62.

The products 10 which are to be opened are conveyed with the outer flat side of the second product part 14 resting on the conveying plane 24. The first product part 12, which rests on the second product part 14, is connected to the latter along the connecting edge 16 and has a strip-like border region 20 which runs along the leading edge 18 located opposite the connecting edge 16 and by way of which the first product part 12 projects beyond the second product part 14. As seen in the conveying direction F, the leading edge 18, once again, leads with respect to the connecting edge 16. The product is conveyed, resting on the conveying plane 24, such that it projects beyond the border 40" of the panel 40 by way of its lateral corner region 28 on the side facing the guiding element 58. The product 10 thus conveyed in the conveying direction F by the conveying means 62 passes into the region of the inlet 60, by way of the lateral corner region 28, and is bent downwards by the guiding element 58, with the result that the first product part 12 butts against the guide surface 56 at least by way of a section of the corner region 28. The guide-belt pair 48, on the one hand, stabilizes the product 10 and, on the other hand, prevents the product 10 from being able to arch in the region of the panel 40. This prevents the first product part 12 from lifting off from the guide surface 56 (FIG. 18).

Figure 19:
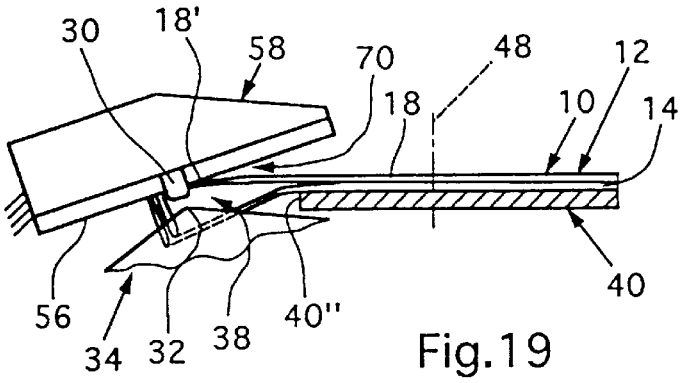
FIG. 19 illustrates, in the same illustration as FIG. 18, part of the apparatus of FIG. 18, during the operation of opening a product.
Figure 20:
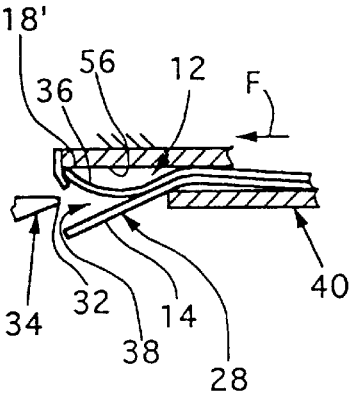
FIG. 20 illustrates, in a vertical section running in the conveying direction, the apparatus of FIGS. 15 to 19 during the operation of opening a product.
Figure 21:
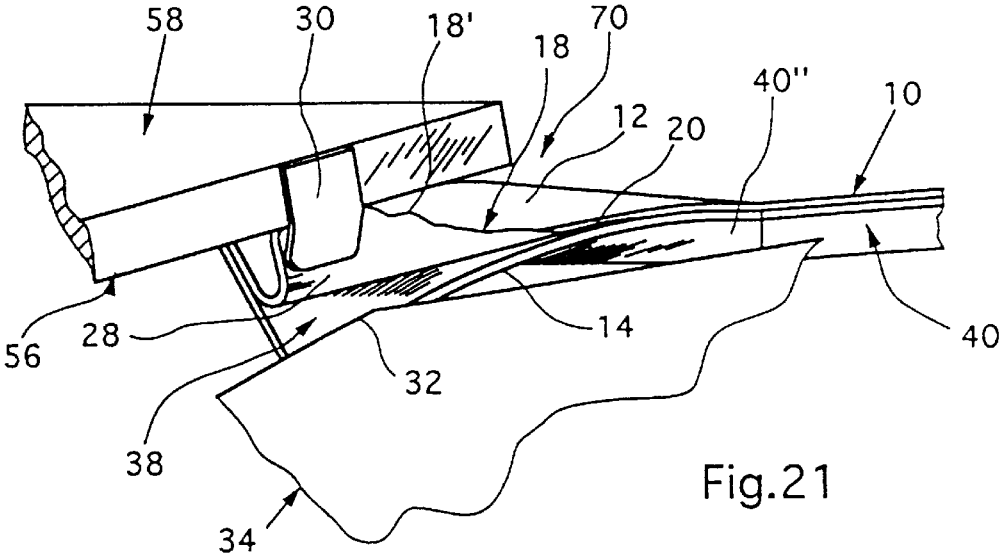
FIG. 21 illustrates, in perspective, part of the apparatus of FIGS. 15 to 20 during the operation of opening a product.

As can be seen from FIG. 16 in conjunction with FIGS. 19, 20 and 21, the leading edge 18 then comes into abutment against the stop 30 by way of the end section 18', as a result of which the first product part 12 is arched downwards in the lateral corner region 28. The arching is designated by 36. The arching results in the second product part 14 lifting off from the first product part 12 in the corner region 28, the opening 38 being formed in the process. As a result, the lifted-off, second product part 14 is deflected beneath the opening part 34, with the result that the tip 32 of the latter comes to rest in the opening 38. As can be seen, in particular, from FIG. 21, the first product part 12, which is resting against the stop, is bent in the form of a U, which results in the end section 18' being lifted off from the stop 30 as soon as the bent-over part of the first product part 12 comes into abutment against the free end of the stop 30. Consequently, the first product part 12 is released automatically from the stop 30 and, as a result of its inherent elasticity, moves back into the flat position, the lateral corner region 28 of the first product part 12 coming into abutment against the guiding element 58. The product 10 is thus held open, and can be opened further still, by means of the holding-open element 34, as is indicated in FIG. 17.

The apparatus shown in FIGS. 15 to 21 can be used to open products 10 which are conveyed in a formation according to FIG. 12 or in an imbricated formation S similar to that in FIG. 13, although in this case each product 10 rests on the preceding product. The first product part 12 is located above the product part 14.

The apparatus according to the invention can be used, without any readjustment, to process products provided individually one after the other and products provided in imbricated formation. The apparatus may also be designed such that it can be readjusted in order to be able to open products with the first product part located on top and those with the first product part located at the bottom.

While particular embodiments of the invention have been described, it will be understood, of course, the invention is not limited thereto since modifications may be made by those skilled in the art, particularly in light of the foregoing teachings. It is therefore, contemplated by the appended claims to cover any such modifications that incorporate those features of these improvements in the true spirit and scope of the invention.

That which is claimed:

1. A method of opening flexible, sheet products having a first and second product part which are connected to one another at a connecting edge wherein a border region of the first product part extends beyond the second product part and the border region extends along a leading edge located opposite the connecting edge, said method comprising the steps of:

conveying the products continuously, one behind the other, in a conveying direction along a convening plane, with the leading edge of each product in front of the connecting edge and extending obliquely with respect to the conveying direction, the products thus having a leading corner at one end of the leading edge and a trailing end section remote from the leading corner;

contacting an outer flat side of the first product part of each product during the conveying step with a guide surface and also contacting the trailing end section of the leading edge of each product with a stationary stop which projects from the guide surface wherein the first product part is arched in a lateral corner region adjacent the trailing end section and the second product part is lifted off from the first product part so as to form an opening;

supporting the lifted-off, second product part during the conveying step on the side thereof facing the first product part by a fixed holding-open element which penetrates into the opening;

further continuously conveying the product along the conveying direction wherein the first product part automatically springs over the stop and is then maintained separate from the second product part by the holding-opening element, and wherein said conveying step includes maintaining a region of each of the products which is adjacent to said lateral corner region thereof substantially in the conveying plane by a guide means.

2. The method as claimed in claim 1, wherein the step of continuously conveying the products includes conveying the products with the first product part resting on the conveying plane, and wherein the conveying plane forms the guide surface.

3. The method as claimed in claim 2, wherein the step of continuously conveying the products includes conveying the products in an imbricated formation wherein each product rests on the following product, leaving the lateral corner region of each exposed.

4. The method as claimed in claim 1, wherein the step of continuously conveying the products includes conveying the products with each of the second product parts resting on the conveying plane and with a lateral corner region of the second product part projecting beyond said conveying plane and so as to be brought into abutment against the guide surface, which forms a gap with the conveying plane and extends obliquely with respect to the conveying plane for arching and opening the product.

5. An apparatus for opening flexible, sheet products, each having a first and second product part which are connected to one another at a connecting edge wherein the first product part projects beyond the second product part so as to define a border region which runs along a leading edge located opposite the connecting edge, said apparatus comprising:

a continuously driven conveying device for conveying the products, which are arranged one behind the other, in a conveying direction along a conveying plane, with the leading edge of each in front of the connecting edge and extending obliquely with respect to the conveying direction, each product thus having a leading corner at one end of the leading edge and a trailing end section remote from the leading corner;

a guide surface for contacting an outer side of each of the first product parts;

a stationary stop which projects from the guide surface and against which the trailing end section of each of the first product parts abut, wherein the first product parts are arched in a lateral corner region thereof, adjacent the trailing end section and the second product part is lifted off from the first product part, thereby defining an opening;

a fixed holding-open element for inserting into the opening and for supporting the lifted-off, second product part on a side thereof facing the first product part and maintaining the second product part separate from the first product part after the first product part has sprung over the stop, and a guide means positioned when viewed in the conveying direction, adjacent the stop and in a laterally offset manner with respect to the stop so that as the first product part is arched, a region of the product which is adjacent to the lateral corner region is maintained substantially in the conveying plane.

6. The apparatus as claimed in claim 5, wherein the stop extends from the guide surface by an amount which is at least greater than the thickness of the first product parts.

7. The apparatus as claimed in claim 5, wherein the guide surface is formed by the conveying plane on which the products are transported with the first product parts resting thereon and wherein the stop extends upwardly from the conveying plane.

8. The apparatus as claimed in claim 5, wherein the conveying device includes the conveying plane on which the products are transported with respective second product parts abutting thereon and with the lateral corner region of each product projecting laterally beyond the conveying plane wherein the guide surface and the conveying plane define a gap for the products and the stop is spaced apart from the conveying plane, when viewed at right angles to the conveying direction.

9. The apparatus as claimed in claim 7, wherein the stop forms an acute angle with the guide surface.

10. The apparatus as claimed in claim 8, wherein the stop forms an acute angle with the guide surface.

11. The apparatus as claimed in claim 7, wherein the conveying device includes a belt conveyor having two conveying belts forming a conveying gap wherein the conveying device acts on the products remote from the lateral corner region.

12. The apparatus as claimed in claim 8, wherein the conveying device includes a belt conveyor having two conveying belts defining a conveying gap for acting on the products remote from the lateral corner region.

13. The apparatus as claimed in claim 7, wherein the conveying device includes clamps which are spaced apart one behind the other on a drawing element wherein each clamp includes a clamp jaw extending obliquely with respect to the conveying direction, wherein the clamps are conveyed in a conveying path including, downstream of the stop, a curve for conveying the products to a discharge location wherein the products are held open by a holding-open element.

14. The apparatus as claimed in claim 7, wherein the conveying device conveys the products in an imbricated formation wherein the products mutually overlap, and the stop acts on the trailing end section of the products, said trailing end section of each product being exposed as a result of the oblique positioning.

15. The apparatus as claimed in claim 8, wherein the conveying device conveys the products in an imbricated formation wherein the products mutually overlap, and the stop acts on the trailing end section of the products, said trailing end section of each product being exposed as a result of the oblique positioning.

* * * * *